US009981178B1

(12) United States Patent
Huynh

(10) Patent No.: US 9,981,178 B1
(45) Date of Patent: May 29, 2018

(54) SNOWBOARD ASSEMBLY

(71) Applicant: Loc Huynh, Huntington Beach, CA (US)

(72) Inventor: Loc Huynh, Huntington Beach, CA (US)

( * ) Notice: Subject to any disclaimer, the term of this patent is extended or adjusted under 35 U.S.C. 154(b) by 0 days. days.

(21) Appl. No.: 15/463,307

(22) Filed: Mar. 20, 2017

(51) Int. Cl.

| | |
|---|---|
| ***A63C 10/14*** | (2012.01) |
| ***A63C 10/26*** | (2012.01) |
| ***A63C 5/07*** | (2006.01) |
| ***A63C 5/075*** | (2006.01) |
| ***A63C 5/03*** | (2006.01) |

(52) U.S. Cl.
CPC ..... *A63C 5/075* (2013.01); *A63C 5/03* (2013.01); *A63C 2203/20* (2013.01)

(58) Field of Classification Search
CPC ..... A63C 2203/46; A63C 5/07; A63C 5/075; A63C 10/14; A63C 10/26
See application file for complete search history.

(56) References Cited

U.S. PATENT DOCUMENTS 6,905,128 B1 * 6/2005 Lear ..... B62B 13/12 280/16
2006/0226613 A1 * 10/2006 Wilson ..... A63C 5/03 280/14.22

* cited by examiner

*Primary Examiner* — Bryan A Evans
(74) *Attorney, Agent, or Firm* — Ahmadshahi & Associates

(57) ABSTRACT

A snowboard assembly includes a snowboard and a suspension system operable to absorb shock and vibration that are generated during use of the assembly. The snowboard is a typical snowboard and the suspension system comprises a suspension platform and two or more struts. Each strut is coupled with the snowboard and the suspension platform via two couplings. In a preferred embodiment, a single strut with two couplings are used to couple the suspension platform with the snowboard.

19 Claims, 4 Drawing Sheets

SNOWBOARD ASSEMBLY

COPYRIGHT

A portion of the disclosure of this patent document contains material which is subject to copyright protection. The owner has no objection to the facsimile reproduction by anyone of the patent disclosure, as it appears in the Patent and Trademark Office files or records, but otherwise reserves all copyright rights whatsoever.

FIELD OF INVENTION

The present invention relates to snowboard having a suspension system so as to absorb the shock and vibrations that are generated during snowboarding. The suspension system is coupled with the snowboard and the user stands on a suspension platform to maneuver the snowboard assembly. The suspension system includes struts which comprise at least one of a shock absorber and a spring. Each strut is coupled with the snowboard and the suspension platform via two couplings.

BACKGROUND

Snowboarding is a popular sport and a typical snowboard is generally a flat board whose bottom surface is in contact with the snow. A typical snowboard generates shock and vibrations during use. These shock and vibrations are transmitted to the user which adversely affect the ride experienced by the user. The adverse effects are amplified when the snowboard is used on steep slopes where the user has to make sharp turns in order to control the speed of the snowboard. The adverse effects are further exacerbated if the slop contains hard snow and/or the course includes moguls. There is a need in the art for a snowboard assembly that eliminates or reduces the forces of shock and vibrations that are generated during use.

SUMMARY

In one aspect, a snowboard assembly is disclosed wherein the assembly comprises a snowboard having a snowboard length and a snowboard width, and a suspension system, comprising a suspension platform having a suspension platform length and a suspension platform width, and two or more struts wherein each of the two or more struts is coupled with the snowboard and the suspension platform, via two couplings, wherein the suspension platform operates to absorb shock and vibration that are generated during use of the snowboard assembly so as to provide a smoother ride for users of the snowboard assembly.

Preferably, each of the two couplings comprise two walls, a base, and a rod disposed between the two walls, wherein one end of each of the two or more struts is rotatably coupled with the rod so as to allow the strut to freely rotate along an axial direction of the rod.

Preferably, the snowboard comprises two or more pluralities of snowboard holes, each of the two or more pluralities of snowboard holes are disposed along the snowboard length.

Preferably, the suspension platform comprises two or more pluralities of suspension platform holes, each of the two or more pluralities of suspension platform holes are disposed along the suspension platform length.

Preferably, the snowboard length is equal to or greater than the suspension platform length.

Preferably, the snowboard width is equal to or greater than the suspension platform width.

Preferably, at least one of the snowboard and suspension platform is made from a composite material.

Preferably, at least one of the two or more struts comprises a shock absorber and a spring.

Preferably, an angle between an axial direction of the snowboard and an axial direction of the suspension platform is in the range from −90 to +90 degrees.

Preferably, an angle between an axial direction of each of the two or more struts and an axial direction of the suspension platform is in the range from 30 degrees to 140 degrees.

Preferably, a vertical height between the snowboard and the suspension platform is less than 6 inches and greater than 4 inches.

In another aspect, a method of absorbing shock and vibration that are generated during use of a snowboard assembly is disclosed so as to provide a smoother ride for users of the snowboard assembly. The method comprises providing a snowboard having a snowboard length and a snowboard width, and providing a suspension system, said suspension system comprising a suspension platform having a suspension platform length and a suspension platform width and two or more struts wherein each of the two or more struts is coupled with the snowboard and the suspension platform, via two couplings.

In another aspect, a snowboard assembly is disclosed wherein the assembly comprises a snowboard having a snowboard length and a snowboard width, and a suspension system, comprising a suspension platform having a suspension platform length and a suspension platform width, and a strut coupled with the snowboard and the suspension platform, via two couplings, wherein the suspension platform operates to absorb shock and vibration that are generated during use of the snowboard assembly so as to provide a smoother ride for users of the snowboard assembly.

DETAILED DESCRIPTION OF THE PRESENTLY PREFERRED EMBODIMENTS

Figure 1:
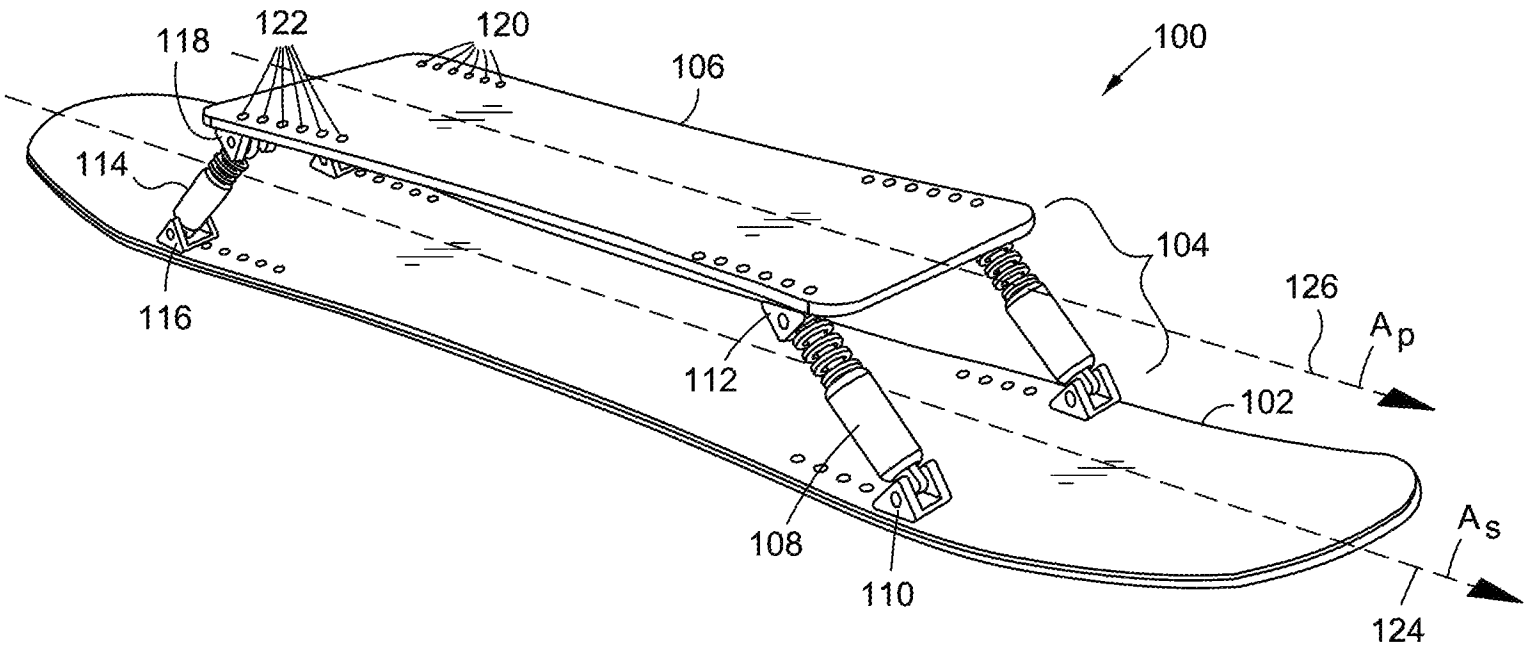
FIG. 1 shows a perspective view of a preferred embodiment of a snowboard assembly including a snowboard and a suspension system comprising a suspension platform, four struts, and eight couplings according to the present invention.

FIG. 1 depicts a perspective view of a preferred embodiment of a snowboard assembly 100 according to the present invention. The snowboard assembly 100 comprises a snowboard 102 and a suspension system 104. The suspension system 104 comprises a suspension platform 106, four struts, two of which are struts 108 and 114, and eight couplings, four of which are couplings 110, 112, 116, and 118. Each strut is coupled with the snowboard 102 and suspension platform 106, via two couplings. For instance, strut 108 is coupled with snowboard 102 and suspension platform 106 via the coupling 110 and the coupling 112. And the strut 114 is coupled with snowboard 102 and suspension platform 106 via the coupling 116 and the coupling 118. In this preferred embodiment, an axis $A_S$ of the snowboard 102 at 124 is parallel to an axis $A_P$ of the suspension platform 106 at 126. The suspension platform 106 operates to absorb shock and vibration that are generated during use of the snowboard assembly 100 so as to provide a smoother ride for users of the snowboard assembly 100. Each of the snowboard 102 and suspension platform 106 may be made from a composite material that are utilized in conventional snowboards.

Each of the snowboard 102 and the suspension platform 106 includes four pluralities of holes. For instance, the suspension platform 106 includes four pluralities of suspension platform holes, two of which are plurality of holes 120 and plurality of holes 122. Each of the pluralities of suspension platform holes 120 and 122 are disposed along the length of the suspension platform 106, and each of the pluralities of snowboard holes are disposed along the length of the snowboard 102. In alternative embodiments, each of the pluralities of suspension platform holes and each of the pluralities of snowboard holes may be disposed along an axis which makes an angle ranging from −90 degrees to +90 degrees with respect to the axes of the suspension platform and snowboard, respectively.

Each of the eight couplings are coupled with the snowboard 102 or the suspension platform 106 via the pluralities of holes. As discussed more fully below in connection with FIGS. 2-5, the couplings can be coupled with the snowboard 102 and the suspension platform 106 at different locations along the lengths of the snowboard 102 and the suspension platform 106, so as to allow the suspension platform 106 to be at different heights with respect to the snowboard 102, and to further allow the struts to couple with the snowboard 102 and suspension platform 106 at different angles, such as nonlimiting angles ranging from 30 degrees to 130 degrees. Additionally, by varying the location of the couplings along the lengths of the snowboard 102 and the suspension platform 106, one is able to affect the stiffness of the snowboard assembly 100.

Figure 2:
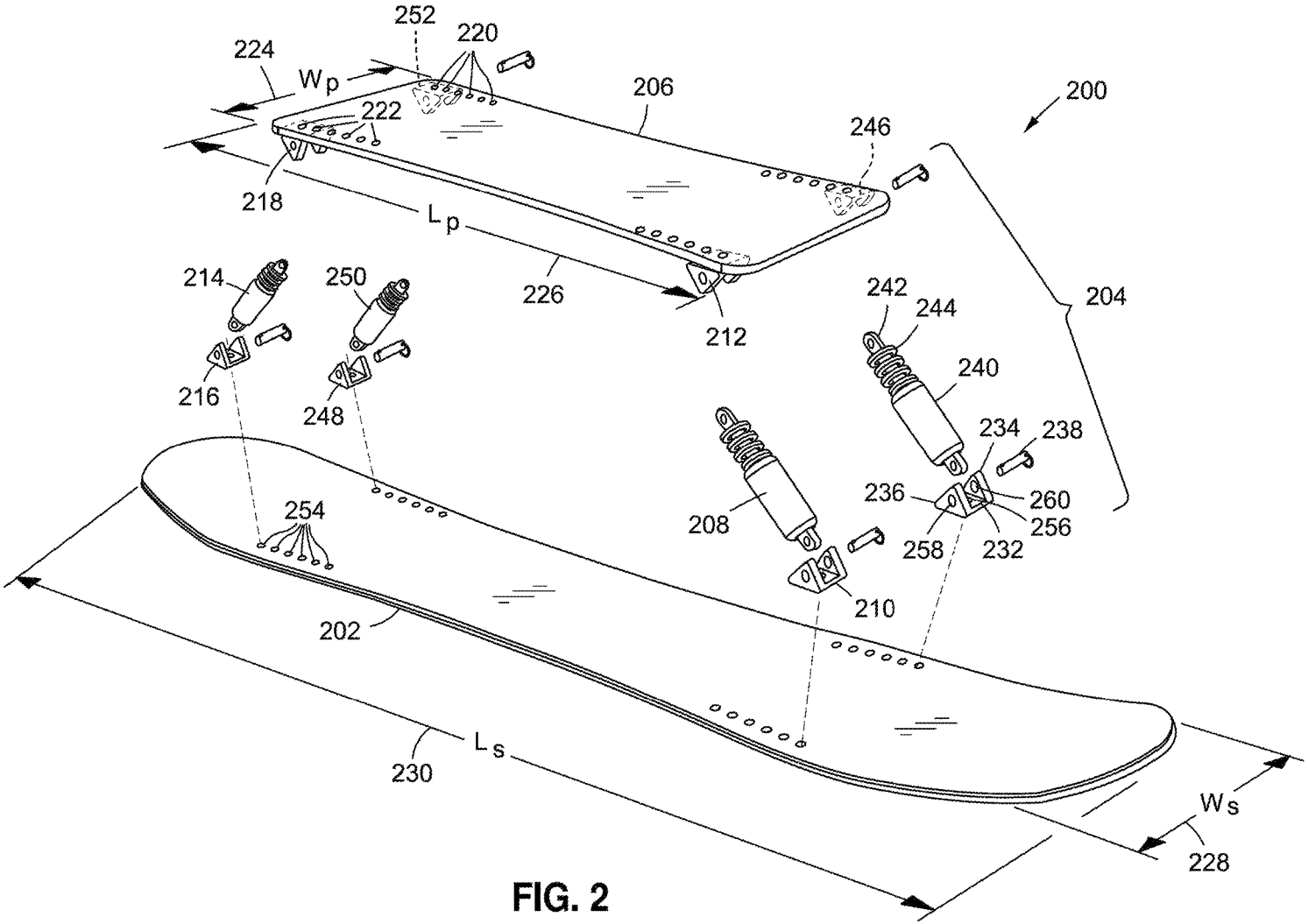
FIG. 2 shows an exploded view of a preferred embodiment of a snowboard assembly including a snowboard and a suspension system comprising a suspension platform, four struts, and eight couplings according to the present invention.

FIG. 2 depicts an exploded view of a preferred embodiment of a snowboard assembly 200 including a snowboard 202 and a suspension system 204 comprising a suspension platform 206, four struts 208, 240, 214, and 250, and eight couplings 210, 212, 232, 246, 248, 252, 216, and 218, according to the present invention. The snowboard 202 has a length $L_S$ at 230 and a width $W_S$ at 228. The snowboard 202 includes 4 pluralities of snowboard holes along the length of the snowboard 202, such as the one shown at 254. The suspension platform 206 has a length $L_P$ at 226 and a width $W_P$ at 224. The suspension platform 206 includes 4 pluralities of suspension platform holes, such as those shown at 220 and 222. The snowboard length $L_S$ can be equal to or greater than the suspension platform length $L_P$. The snowboard width Ws can be equal to or greater than the suspension platform width $W_P$.

Each of the eight couplings 210, 212, 232, 246, 248, 252, 216, and 218 include two walls, a base; and a rod disposed between the two walls, wherein one end of each of the two or more struts is rotatably coupled with the rod so as to allow the strut to freely rotate along an axial direction of the rod. For instance, the coupling 232 includes a base 256, a first triangular wall 236 and a second triangular wall 234, and a rod 238. Each of the first triangular wall 236 and the second triangular wall 234 includes a through hole where the rod 238 is positioned. In an alternative embodiment, the rod 238 is positioned in the through holes 258 and 260 via ball bearings (not shown). Each of the struts 208, 240, 214, and 250 includes a shock absorber and a spring, such the strut 240 having the shock absorber 242 and spring 244.

Figure 3:
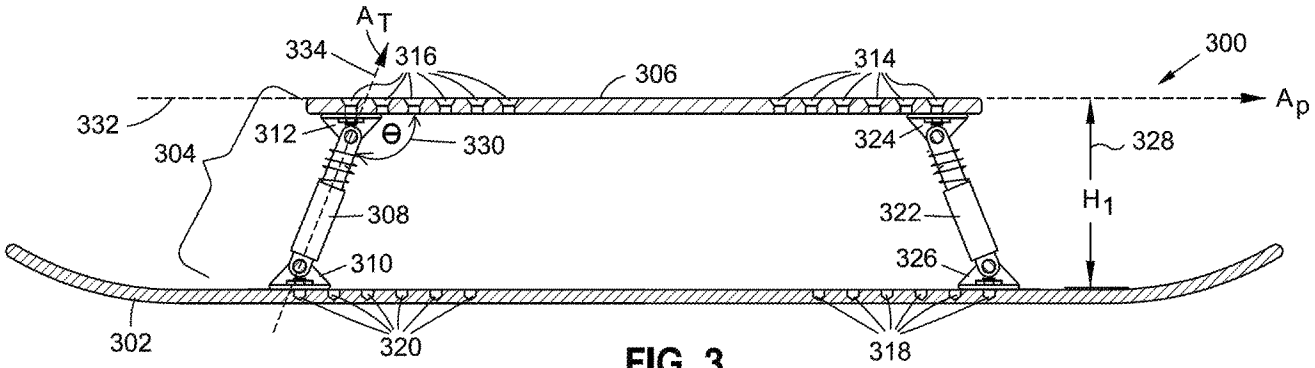
FIG. 3 shows a cross sectional view of a preferred embodiment of a snowboard assembly further illustrating a configuration of the suspension system according to the present invention.

FIG. 3 depicts a cross sectional view of a preferred embodiment of a snowboard assembly 300 further illustrating a configuration of a suspension system 304 coupled with a snowboard 302 according to the present invention. The snowboard 302 includes four pluralities of holes, two of which are shown in this figure as plurality of holes 318 and plurality of holes 320. In a preferred embodiment, the plurality of holes 318 and plurality of holes 320 are blind holes so as to ensure that the bottom surface of the snowboard 302 is smooth. The suspension system 304 comprises a suspension platform 306, four struts, two of which are shown in this figure as strut 308 and strut 322, and eight couplings, four of which are shown in this figure as couplings 310, 312, 324, and 326. The strut 308 is coupled with the suspension platform 306 and the snowboard 302 via the couplings 312 and 310, respectively. The strut 322 is coupled with the suspension platform 306 and the snowboard 302 via the couplings 324 and 326, respectively. The suspension platform 306 includes four pluralities of holes, two of which are shown in this figure as plurality of holes 314 and plurality of holes 316. In a preferred embodiment, the plurality of holes 314 and plurality of holes 316 are through holes.

An angle θ at 330 between an axial axis $A_T$ of the strut 308 at 334 and an axial axis $A_P$ of the suspension platform 306 at 332 can be varied by coupling each of the eight couplings along the length of the snowboard 302 and suspension platform 306 at different locations. For instance, by moving the couplings 312 and 324 along the length of the suspension platform 306, in opposite directions, while keeping the couplings 310 and 326 at the same locations, one is able to change the angle θ and the height H between the suspension platform 306 and the snowboard 302.

Figure 4:
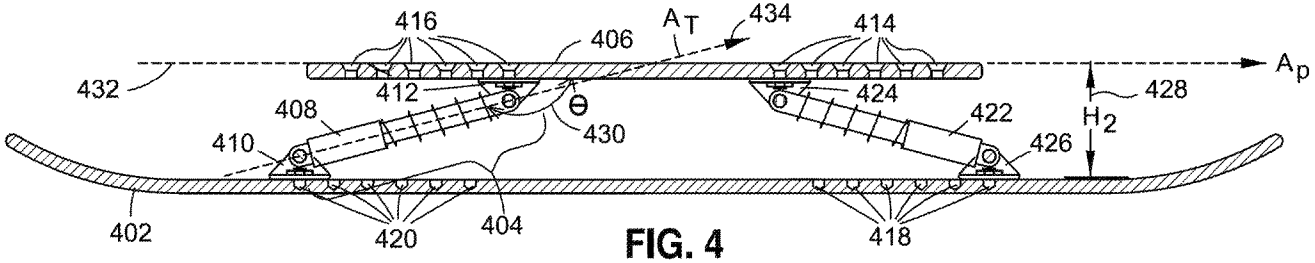
FIG. 4 shows a cross sectional view of a preferred embodiment of a snowboard assembly further illustrating a configuration of the suspension system according to the present invention.

FIG. 4 depicts a cross sectional view of a preferred embodiment of a snowboard assembly 400 further illustrating a configuration of a suspension system 404 coupled with a snowboard 402 according to the present invention. The snowboard 402 includes four pluralities of holes, two of which are shown in this figure as plurality of holes 418 and plurality of holes 420. In a preferred embodiment, the plurality of holes 418 and plurality of holes 420 are blind holes so as to ensure that the bottom surface of the snowboard 402 is smooth. The suspension system 404 comprises a suspension platform 406, four struts, two of which are shown in this figure as strut 408 and strut 422, and eight couplings, four of which are shown in this figure as couplings 410, 412, 424, and 426. The strut 408 is coupled with the suspension platform 406 and the snowboard 402 via the couplings 412 and 410, respectively. The strut 422 is coupled with the suspension platform 406 and the snowboard 402 via the couplings 424 and 426, respectively. The suspension platform 406 includes four pluralities of holes, two of which are shown in this figure as plurality of holes 414 and plurality of holes 416. In a preferred embodiment, the plurality of holes 414 and plurality of holes 416 are through holes.

An angle θ at 430 between an axial axis $A_T$ of the strut 408 at 434 and an axial axis $A_P$ of the suspension platform 406 at 432 can be varied by coupling each of the eight couplings along the length of the snowboard 402 and suspension platform 406 at different locations. As compared with FIG. 3, the couplings 412 has moved to the right and coupling 424 has moved to the left along the length of the suspension platform 406, while keeping the couplings 410 and 426 at the same locations. This configuration has increased the angle θ, say from 125 degrees to 130 degrees, and has decreased the height H, say from 6 inches to 4 inches.

Figure 5:
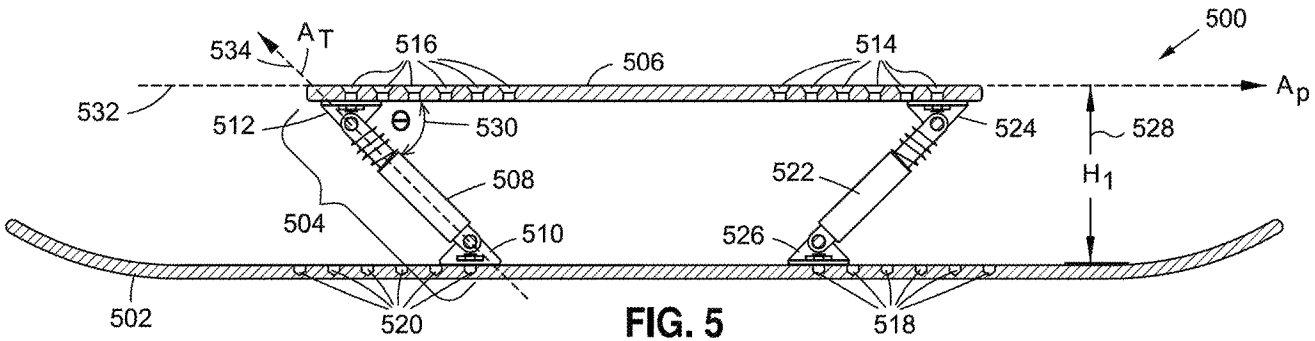
FIG. 5 shows a cross sectional view of a preferred embodiment of a snowboard assembly further illustrating a configuration of the suspension system according to the present invention.

FIG. 5 depicts a cross sectional view of a preferred embodiment of a snowboard assembly 500 further illustrating a configuration of a suspension system 504 coupled with a snowboard 502 according to the present invention. The snowboard 502 includes four pluralities of holes, two of which are shown in this figure as plurality of holes 518 and plurality of holes 520. In a preferred embodiment, the plurality of holes 518 and plurality of holes 520 are blind holes so as to ensure that the bottom surface of the snowboard 502 is smooth. The suspension system 504 comprises a suspension platform 506, four struts, two of which are shown in this figure as strut 508 and strut 522, and eight couplings, four of which are shown in this figure as couplings 510, 512, 524, and 526. The strut 508 is coupled with the suspension platform 506 and the snowboard 502 via the couplings 512 and 510, respectively. The strut 522 is coupled with the suspension platform 506 and the snowboard 502 via the couplings 524 and 526, respectively. The suspension platform 506 includes four pluralities of holes, two of which are shown in this figure as plurality of holes 514 and plurality of holes 516. In a preferred embodiment, the plurality of holes 514 and plurality of holes 516 are through holes.

An angle θ at 530 between an axial axis $A_T$ of the strut 508 at 534 and an axial axis $A_P$ of the suspension platform 506 at 532 can be varied by coupling each of the eight couplings along the length of the snowboard 502 and suspension platform 506 at different locations. As compared with FIG. 3, the couplings 512 and 524 are at the same locations, as in FIG. 3, coupling 510 has moved has moved to the right, and coupling 526 has moved to the left along the length of the snowboard 502. This configuration has decreased the angle θ, say from 125 degrees to 35 degrees, but the height H is the same as in FIG. 3.

Figure 6:
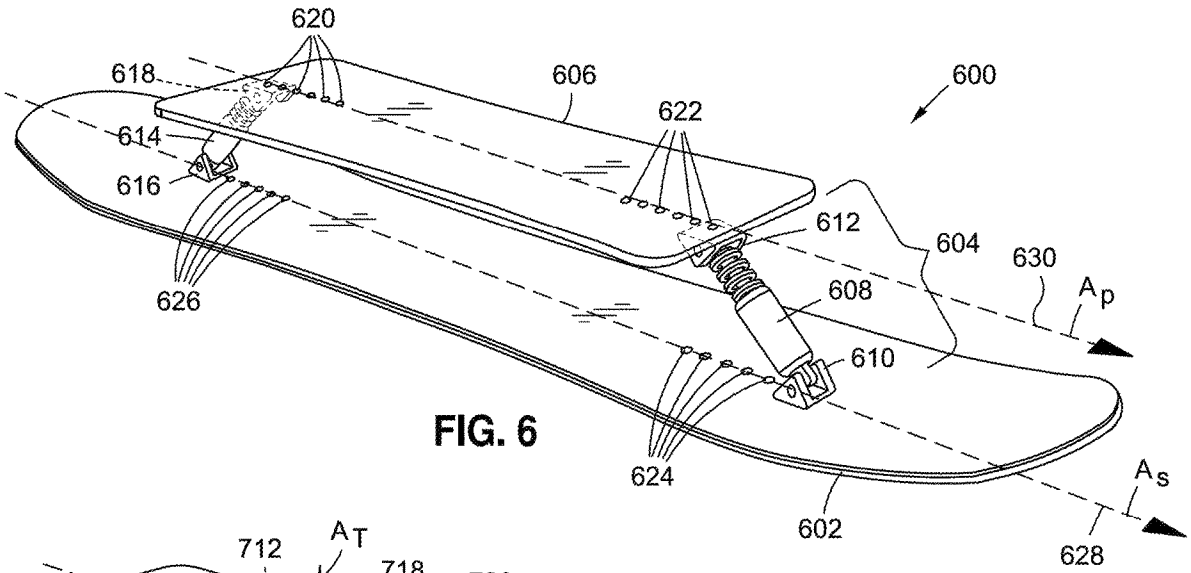
FIG. 6 shows a perspective view of a preferred embodiment of a snowboard assembly including a snowboard and a suspension system comprising a suspension platform, two struts, and four couplings according to the present invention.

FIG. 6 depicts a perspective view of a preferred embodiment of a snowboard assembly 600 according to the present invention. The snowboard assembly 600 comprises a snowboard 602 and a suspension system 604. The suspension system 604 comprises a suspension platform 606, two struts 608 and 614, and four couplings 610, 612, 616, and 618. Each strut is coupled with the snowboard 602 and suspension platform 606, via two couplings. For instance, strut 608 is coupled with snowboard 602 and suspension platform 606 via the coupling 610 and the coupling 612. And the strut 614 is coupled with snowboard 602 and suspension platform 606 via the coupling 616 and the coupling 618. In this preferred embodiment, an axis $A_S$ of the snowboard 602 at 628 is parallel to an axis $A_P$ of the suspension platform 606 at 630. The suspension platform 606 operates to absorb shock and vibration that are generated during use of the snowboard assembly 600 so as to provide a smoother ride for users of the snowboard assembly 600. Each of the snowboard 602 and suspension platform 606 may be made from a composite material that are utilized in conventional snowboards.

Each of the snowboard 602 and the suspension platform 606 includes two pluralities of holes. For instance, the suspension platform 606 includes two pluralities of suspension platform holes 620 and plurality of holes 622. Each of the pluralities of suspension platform holes 620 and 622 are disposed along the length of the suspension platform 606 on the centerline, and each of the pluralities of snowboard holes 624 and 626 are disposed along the length of the snowboard 602 on the centerline. In alternative embodiments, each of the pluralities of suspension platform holes 620 and 622, and each of the pluralities of snowboard holes 624 and 626 may be disposed along an axis which makes an angle ranging from −90 degrees to +90 degrees with respect to the axes of the suspension platform and snowboard, respectively.

Each of the four couplings are coupled with the snowboard 602 or the suspension platform 606 via the pluralities of holes 620, 622, 624, and 626. As discussed above in connection with FIGS. 2-5, the couplings can be coupled with the snowboard 602 and the suspension platform 606 at different locations along the lengths of the snowboard 602 and the suspension platform 606, so as to allow the suspension platform 606 to be at different heights with respect to the snowboard 602, and to further allow the struts 608 and 614 to couple with the snowboard 602 and suspension platform 606 at different angles, such as nonlimiting angles ranging from 30 degrees to 130 degrees. Additionally, by varying the location of the couplings along the lengths of the snowboard 602 and the suspension platform 606, one is able to affect the stiffness of the snowboard assembly 600.

Figure 7:
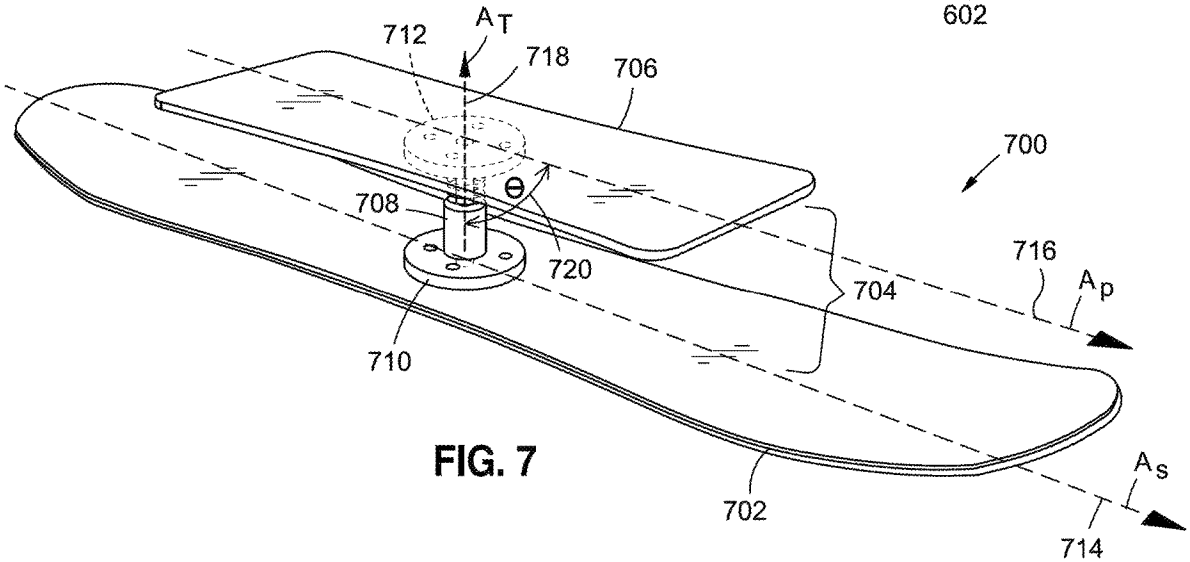
FIG. 7 shows a perspective view of a preferred embodiment of a snowboard assembly including a snowboard and a suspension system comprising a suspension platform, one strut, and two couplings according to the present invention.

FIG. 7 depicts a perspective view of a preferred embodiment of a snowboard assembly 700 according to the present invention. The snowboard assembly 700 comprises a snowboard 702 and a suspension system 704. The suspension system 704 comprises a suspension platform 706, one strut 708, and two couplings 710 and 712, 616. The strut 708 is coupled with the snowboard 702 and suspension platform 706, via the couplings 710 and 712. Unlike the couplings used in FIGS. 1 through 6 above, the couplings 710 and 712 do not allow the strut 708 to rotate. As such, an angle θ at 720 between an axial axis $A_T$ of the strut 708 at 718, on the one hand, and an axial axis $A_P$ of the suspension platform 706 at 716 and an axial axis $A_S$ of the snowboard 702, on the other hand, is always at 90 degrees.

The foregoing explanations, descriptions, illustrations, examples, and discussions have been set forth to assist the reader with understanding this invention and further to demonstrate the utility and novelty of it and are by no means restrictive of the scope of the invention. It is the following claims, including all equivalents, which are intended to define the scope of this invention.

What is claimed is:

1. A snowboard assembly, comprising:

(a) a unitary snowboard having a snowboard length and a snowboard width; and (b) a suspension system, comprising:

(i) a unitary suspension platform having a suspension platform length and a suspension platform width; and (ii) two or more struts wherein each of the two or more struts is rotatably coupled with the snowboard and the suspension platform at two distal ends of each of said snowboard and said suspension platform, via two couplings;

wherein the suspension platform and the snowboard are coupled such that there is a central clearance between said snowboard and said suspension platform;

wherein loads between the snowboard and the suspension platform are exerted only via the two or more struts; and wherein the suspension platform operates to absorb shock and vibration that are generated during use of the snowboard assembly so as to provide a smoother ride for users of the snowboard assembly.

2. The snowboard assembly of claim 1, wherein each of the two couplings comprise:

(a) two walls;

(b) a base; and (c) a rod disposed between the two walls;

wherein one end of each of the two or more struts is rotatably coupled with the rod so as to allow the strut to freely rotate along an axial direction of the rod.

3. The snowboard assembly of claim 1, wherein the snowboard comprises two or more pluralities of snowboard hole, each of the two or more pluralities of snowboard holes are disposed along the snowboard length.

4. The snowboard assembly of claim 1, wherein the suspension platform comprises two or more pluralities of suspension platform holes, each of the two or more pluralities of suspension platform holes are disposed along the suspension platform length.

5. The snowboard assembly of claim 1, wherein the snowboard length is equal to or greater than the suspension platform length.

6. The snowboard assembly of claim 1, wherein the snowboard width is equal to or greater than the suspension platform width.

7. The snowboard assembly of claim 1, wherein at least one of the snowboard and suspension platform is made from a composite material.

8. The snowboard assembly of claim 1, wherein at least one of the two or more struts comprises a shock absorber and a spring.

9. The snowboard assembly of claim 1, wherein an angle between an axial direction of the snowboard and an axial direction of the suspension platform is in the range from −90 to +90 degrees.

10. The snowboard assembly of claim 1, wherein an angle between an axial direction of each of the two or more struts and an axial direction of the suspension platform is in the range from 30 degrees to 140 degrees.

11. The snowboard assembly of claim 1, wherein a vertical height between the snowboard and the suspension platform is less than 6 inches and greater than 4 inches.

12. A method of absorbing shock and vibration that are generated during use of a snowboard assembly so as to provide a smoother ride for users of the snowboard assembly, said method, comprising:

(a) providing a unitary snowboard having a snowboard length and a snowboard width; and (b) providing a suspension system, said suspension system comprising:

(i) a unitary suspension platform having a suspension platform length and a suspension platform width; and (ii) two or more struts wherein each of the two or more struts is rotatably coupled with the snowboard and the suspension platform at two distal ends of each of said snowboard and said suspension platform, via two couplings, wherein, the suspension platform and the snowboard are coupled such that there is a central clearance between said snowboard and said suspension platform, and wherein loads between the snowboard and the suspension platform are exerted only via the two or more struts.

13. The method of claim 12, wherein each of the two couplings comprise:

(a) two walls;

(b) a base; and (c) a rod disposed between the two walls;

wherein one end of each of the two or more struts is rotatably coupled with the rod so as to allow the strut to freely rotate along an axial direction of the rod.

14. The method of claim 12, wherein the snowboard comprises two or more pluralities of snowboard holes, each of the two or more pluralities of snowboard holes are disposed along the snowboard length.

15. The method of claim 12, wherein the suspension platform comprises two or more pluralities of suspension platform holes, each of the two or more pluralities of suspension platform holes are disposed along the suspension platform length.

16. The method of claim 12, wherein the snowboard length is equal to or greater than the suspension platform length.

17. The method of claim 12, wherein the snowboard width is equal to or greater than the suspension platform width.

18. The method of claim 12, wherein an angle between an axial direction of each of the two or more struts and an axial direction of the suspension platform is in the range from 30 degrees to 140 degrees.

19. The method of claim 12, wherein a vertical height between the snowboard and the suspension platform is less than 6 inches and greater than 4 inches.

* * * * *